US008801585B2

(12) United States Patent
Carter

(10) Patent No.: US 8,801,585 B2
(45) Date of Patent: Aug. 12, 2014

(54) ASSEMBLY AND METHOD OF FOLDING MATERIALS

(75) Inventor: Steven W. Carter, Wildwood, MO (US)

(73) Assignee: Nice-Pak Products, Inc., Orangeburg, NY (US)

( * ) Notice: Subject to any disclaimer, the term of this patent is extended or adjusted under 35 U.S.C. 154(b) by 51 days.

(21) Appl. No.: 13/586,720

(22) Filed: Aug. 15, 2012

(65) Prior Publication Data

US 2014/0051561 A1 Feb. 20, 2014

(51) Int. Cl.
*B31B 1/56* (2006.01)

(52) U.S. Cl.
USPC ..... 493/454; 493/471; 493/473

(58) Field of Classification Search
USPC ..... 493/454, 471, 473, 476–479
See application file for complete search history.

(56) References Cited

U.S. PATENT DOCUMENTS

2007/0243987 A1* 10/2007 Anelli et al. ..... 493/254
2012/0021885 A1* 1/2012 De Gooyer et al. ..... 493/405

* cited by examiner

*Primary Examiner* — Stephen F Gerrity
*Assistant Examiner* — Eyamindae Jallow
(74) *Attorney, Agent, or Firm* — Christie, Parker & Hale, LLP

(57) ABSTRACT

A detachable assembly having multiple adjustable components is provided for folding various materials, such as a sheet of disposable wipes. In one embodiment, the assembly includes an attachment bracket configured to detachably connect the assembly to a structural member, a roller, a feeder plate having a return flange, and a folding bracket. In another embodiment, the assembly includes a mounting bracket having at least one hook configured to detachably receive the attachment bracket. In a further embodiment, the feeder plate is formed from two tapered halves which are slideably connected. In use, a material is a fed over the roller, down along the feeder plate, and then forward along the return flange where the folding bracket folds the material inward over the return flange. The user may adjust the position of the feeder plate and the folding bracket to achieve the desired fold width in the material.

17 Claims, 8 Drawing Sheets

70
77
77
69
67
14
150
66
155
65
60
64
68

65
60
63
62
61
64

155
66
152
148
153
145
146
151
147

77
69
79
77
67
78
68
71
73
72
75
74
76

91
105
104
103

113
116
114
88/87
112

15
85
88
90
91
115
87
89
95
86

105
91
104
103
100
92
86
101
99
102
98
93
84
97
96
94
95
95

110
111
85

120
125
128
122
127
127
128
128
138
131
121
126
134
149
140
143
16

123
124
126
16
137
140
131
133
149
132
143
134
135
136

16
128
128
121
134
141
142
130
125
130
126
128
122
137

ASSEMBLY AND METHOD OF FOLDING MATERIALS

TECHNICAL FIELD

This application relates generally to manufacturing assemblies, and more particularly, to manufacturing assemblies configured to fold materials.

BACKGROUND OF THE INVENTION

Disposable wipes for personal hygienic use or disinfectant use are typically housed in a portable container or package. Wipes are sometimes folded within the container or package to enable the user to easily retrieve the wipes and to help retain the moisture, if any, of the wipes while stored in the container or package. Moreover, the width of the fold typically varies depending upon the type of wipe and the size of the container or package in which the wipes will be stored. A folding assembly is typically installed along an assembly line in order to fold the material prior to packaging. Conventional folding assemblies are capable of producing a finished material with only a single finished width, or require several time-consuming adjustments to produce different fold widths. Accordingly, a manufacturer of folded materials incur great time and expense adjusting the folding assembly to produce a variety of different fold widths to meet customer demands, especially when the adjustments are made to a series of typical folding assemblies installed along an assembly line.

As such, there is a need for a folding assembly that is quickly and conveniently detachable from a supporting structure such that a manufacturer can swap out folding assemblies with different configurations in order to produce finished materials with different fold widths. Additionally, there is a need for a folding assembly which is configured to quickly and conveniently adjust into different configurations according to the desired fold width of the material.

SUMMARY OF THE INVENTION

The present invention is directed to an assembly for folding materials. In one embodiment, the folding assembly comprises an attachment bracket configured to detachably connect the assembly to a structural member, a roller configured to connect to the attachment bracket, a feeder plate having a return flange configured to connect to the attachment bracket, and a folding bracket configured to connect to the attachment bracket, wherein the folding bracket is configured to fold at least a portion of a material about the return flange. In a more detailed embodiment, the folding assembly includes a mounting bracket having at least one hook portion forming a U-shaped cavity, wherein the cavity is configured to detachably receive the attachment bracket. In another embodiment, the folding assembly includes a support rod configured to connect to the attachment bracket and an extension arm having a clevis portion configured to rotatably connect to the support rod and a support bar configured to rotatably support the roller. The roller is rotatable to align the roller with the feeder plate. In a further embodiment, the folding assembly includes a support block having a clevis portion configured to slideably connect to the support rod and a portion configured to support the feeder plate. In another embodiment, the support rod includes an etched scale configured to aid the user in slideably positioning the support block along the support rod. In yet a further embodiment, the folding assembly includes a second support rod configured to extend through an opening in the support block. The second support rod connects the folding bracket to the support block. In one embodiment, the folding assembly comprises an L-shaped rod configured to connect to the second support rod and the folding bracket. In a further embodiment, the feeder plate is formed from two tapered halves which are slideably connected by a reinforcement plate. The two tapered halves of the feeder plate are adjustable to increase or decrease the resultant fold width in the material. Additionally, the folding bracket is slideable and rotatable to increase or decrease the resultant fold width.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

The present invention relates generally to manufacturing assemblies and, more particularly, to folding assemblies configured to fold a sheet of material. In general, the folding assembly is provided to fold a sheet of material, such as a roll of disposable sanitary wipes, prior to packaging the material. Additionally, the folding assembly is configured to be easily and quickly attached and detached from a support structure, and to be easily adjusted into various configurations based upon the desired fold width in the material.

Figure 1:
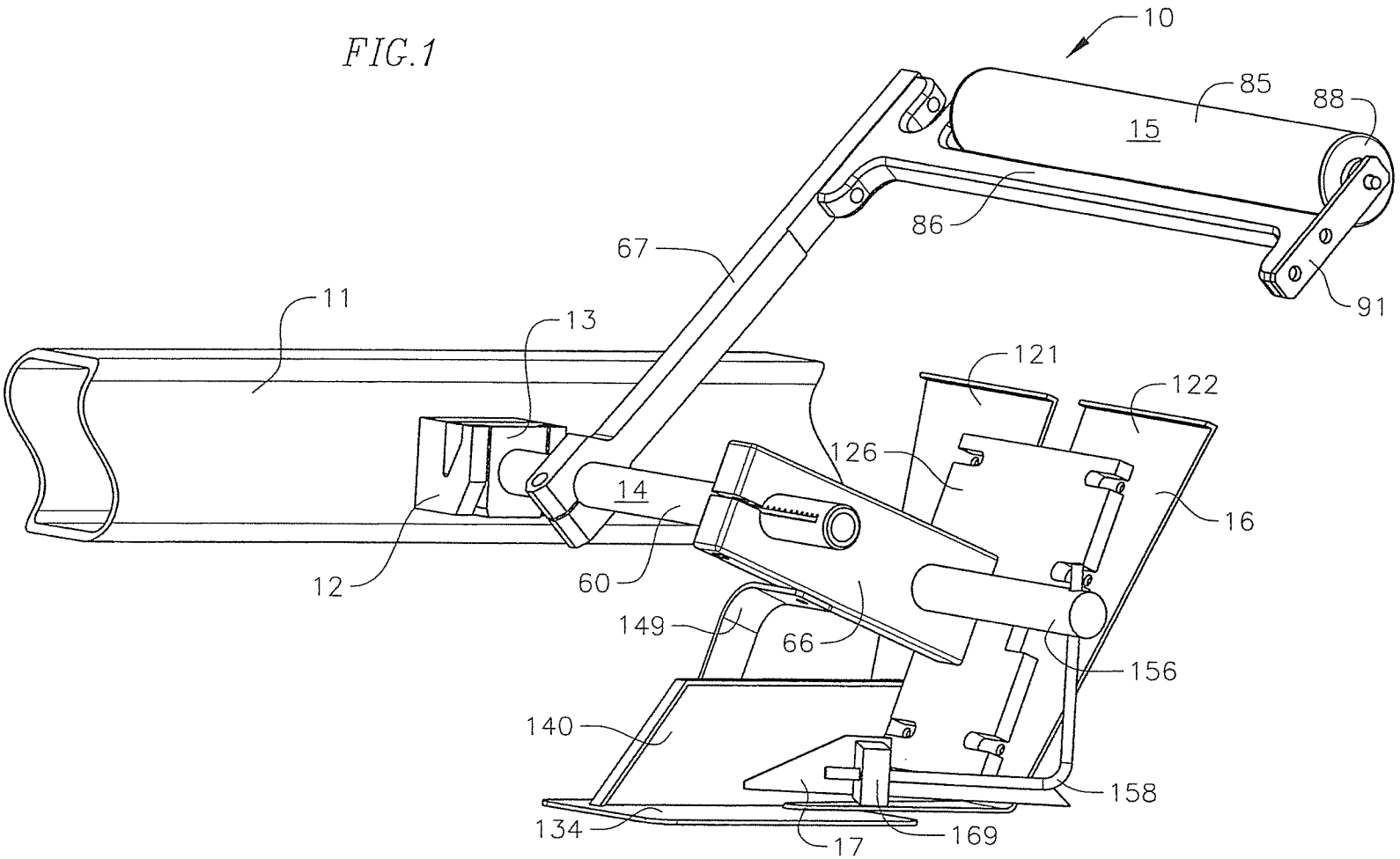
FIG. 1 is a perspective view of an embodiment of the detachable folding assembly.
Figure 2:
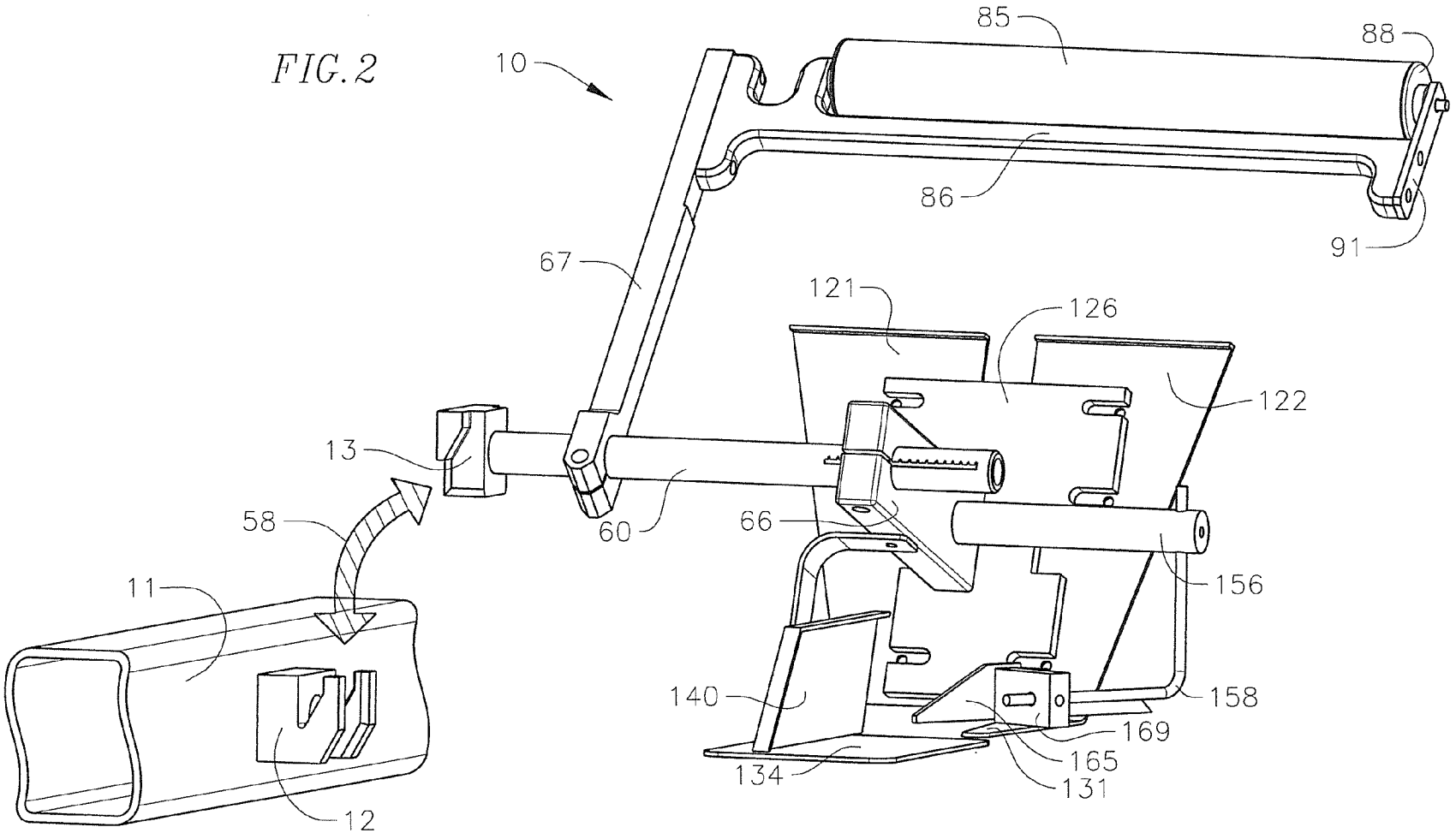
FIG. 2 is a perspective view of an embodiment of the detachable folding assembly showing the detachability of the assembly.

In an embodiment of the present invention shown in FIGS. 1-2, a detachable folding assembly 10 is provided for folding various materials, such as disposable disinfectant wipes. In one embodiment, the folding assembly 10 may be installed as a component along an assembly line configured to package disposable wipes into containers. The folding assembly 10 is configured to be detachably connected to a support structure 11, such as support posts or railing in a manufacturing facility, as shown in FIGS. 1 and 2. The detachability of the folding assembly 10 enables a user to quickly and efficiently swap out various folding assemblies 10 with different configurations based upon the desired fold width. In the present embodiment, the folding assembly 10 comprises a mounting bracket 12 configured to attach to the support structure 11, an attachment bracket 13 configured to detachably connect to the mounting bracket 12, a support arm assembly 14 configured to connect to the attachment bracket 13 at one end and configured to connect to a roller assembly 15 at another end, a feeder plate assembly 16, and a folding bracket assembly 17.

Figure 3A:
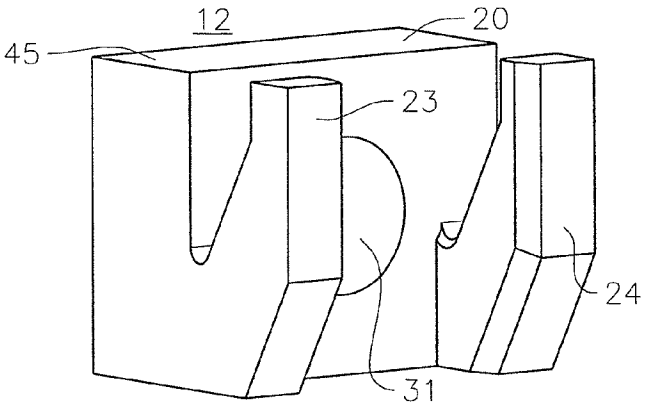
FIGS. 3A, 3B, and 3C are a perspective view, side view, and bottom view of an embodiment of a mounting bracket, respectively, of the folding assembly of FIG. 1.
Figure 3C:
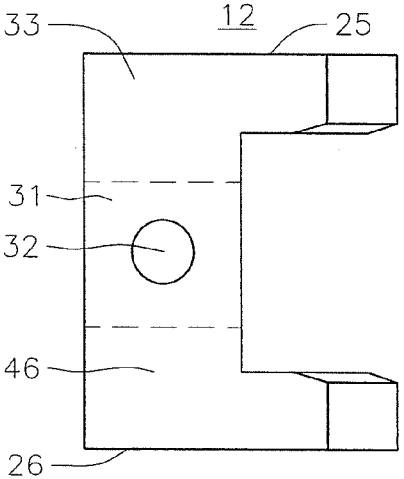
Figure 3B:
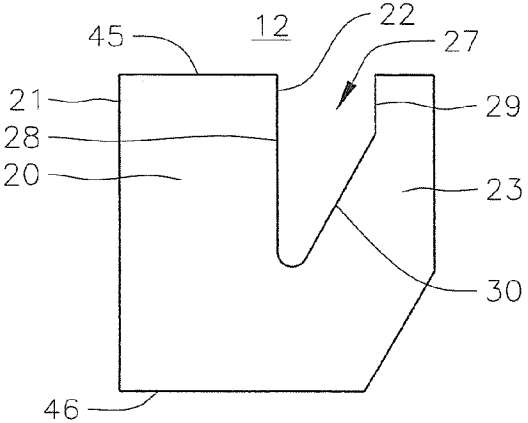

Referring now to FIGS. 3A-3C, in one embodiment the mounting bracket 12 comprises a substantially rectangular base 20 having an inner surface 21 and an outer surface 22, and two hook-shaped protrusions 23, 24 extending from the outer surface 22 of the base portion 20. The inner surface 21 of the mounting bracket 12 is configured to mate with the support structure 11. The hook-shaped protrusions 23, 24 are formed on a forward end 25 and a back end 26, respectively, of the mounting bracket 12. As shown in FIG. 3B, the hook-shaped protrusions 23, 24 form a substantially U-shaped cavity 27 for detachably receiving the attachment bracket 13, described below. The cavity 27 has an open upper portion and is formed from two substantially vertical walls 28, 29 and an oblique wall 30 connecting the lower ends of the vertical walls 28, 29. In one embodiment, the oblique wall portion 30 slopes downward toward the inner surface 21. The base portion 20 of the mounting bracket 12 also comprises a larger opening 31, such as a circular hole, extending from the inner surface 21 to the outer surface 22. The base portion 20 of the mounting bracket 12 also contains a smaller opening 32, such as an internally threaded bore hole, extending from a lower surface 33 of the base portion 20 and opening up into the larger opening 31. The larger opening 31 is configured to receive a cylindrical rod extending from the support structure 11 onto which the folding assembly 10 is detachably connected. That is, the larger opening 31 is configured to connect the mounting bracket 12 to the support structure 11. The smaller opening 32 is configured to receive a fastener, such as a wing nut screw or knob set screw, configured to secure the mounting bracket 12 to the support structure 11. An appropriate fastener is selected such that the threads of the fastener are configured to extend through the smaller opening 32 and engage the cylindrical rod extending into the larger opening 31 from the support structure 11. In use, a user tightens the fastener until the fastener engages the cylindrical rod, which thereby supplies a frictional force that prevents, or at least resists, the mounting bracket 12 from inadvertently disengaging the mounting structure 11.

Figure 4B:
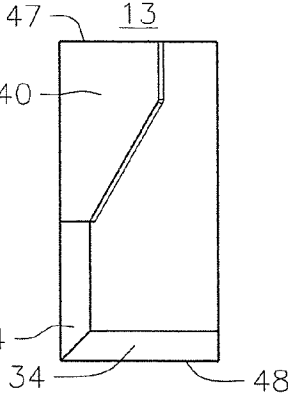
FIGS. 4A, 4B, and 4C are a perspective view, side view, and bottom view of an embodiment of an attachment bracket, respectively, of the folding assembly of FIG. 1.
Figure 4A:
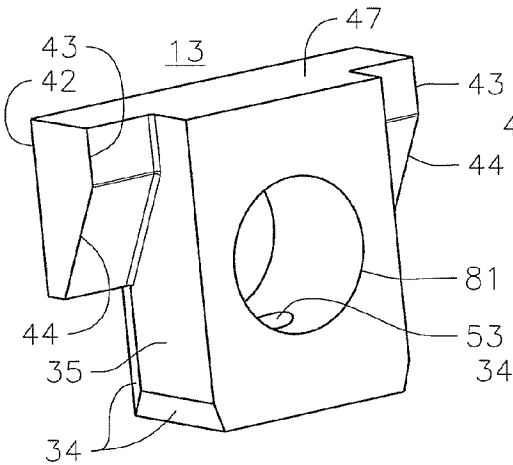
Figure 4C:
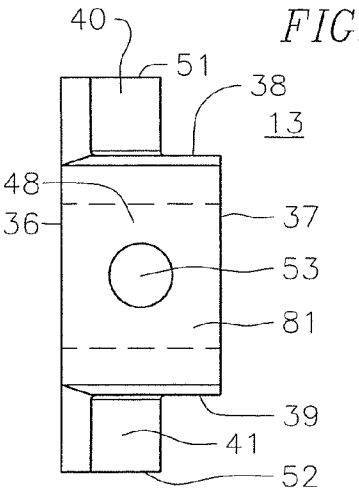

Referring now to FIGS. 4A-4C, in one embodiment the attachment bracket 13 is comprised of a rectangular block 35 having an inner surface 36, an outer surface 37, a front surface 38, and a back surface 39. In one embodiment, two trapezoidal protrusions 40, 41 are formed on the front surface 38 and the back surface 39, respectively, of the block portion 35. Similar to the U-shaped cavities 27 in the mounting bracket 12 described above, the trapezoidal protrusions 40, 41 on the attachment bracket 13 are formed from two substantially vertical walls 42, 43 and an oblique wall 44 connecting the two vertical walls 42, 43. The trapezoidal protrusions 40, 41 in the attachment bracket 13 are configured to nest in the cavities 27 formed by the hook-shaped protrusions 23, 24 on the mounting bracket 12. Specifically, the vertical walls 42, 43 of the trapezoidal protrusions 40, 41 are configured to rest substantially flush against the vertical walls 28, 29 of the cavities 27, and the oblique walls 44 of the trapezoidal protrusions 40, 41 are configured to rest substantially flush against the oblique walls 30 of the cavities 27 formed in the mounting bracket 12, as shown in FIG. 1. Moreover, as illustrated in FIG. 1, when the attachment bracket 13 is attached to the mounting bracket 12, upper and lower surfaces 45, 46 of the mounting bracket 12 are substantially flush with upper and lower surfaces 47, 48 respectively of the attachment bracket 13. Similarly, the front and back surfaces 25, 26 of the mounting bracket 12 are substantially flush with front and back surfaces 51, 52, respectively, of the trapezoidal protrusions 40, 41 formed on the attachment bracket 13 when the attachment bracket 13 is connected to the mounting bracket 12. In one embodiment, the attachment bracket 13 also comprises chamfered or beveled edges 34 on the front surface 38 and the back surface 39 of the block portion 35 which are configured to substantially prevent contact, and the potential for crack formation, with the inside radius formed between the hook-shaped protrusions 23, 24 and the base portion 20 of the mounting bracket 12.

The oblique walls 30 of the cavities 27 and the corresponding oblique walls 44 of the protrusions 40, 41 formed on the attachment bracket 13 permit the user to detach the folding assembly 10 by lifting the assembly 10 upwards and then moving the assembly 10 away from the wall support 11 at a sloped angle, as illustrated by arrow 58 in FIG. 2. Said another way, the oblique walls 30 and 44 permit the user to detach the attachment bracket 13 from the mounting bracket 12 by lifting the attachment bracket 13 out of the mounting bracket 12 at a sloped angle (arrow 58 in FIG. 2), rather than straight up, which might be cumbersome or otherwise difficult for the user. However, it will be appreciated that entirely vertical walls could be used on the cavities 27 and protrusions 40, 41 without departing from the spirit and scope of the invention.

With continued reference to FIGS. 4A and 4C, in one embodiment the attachment bracket 13 has a larger opening 81, such as a through hole, extending between the inner surface 36 and the outer surface 37. The larger opening 81 is configured to receive a support rod 60. Additionally, the lower surface 48 of the attachment bracket 13 comprises a smaller opening 53, such as a threaded bore, extending from the lower surface 48 of the attachment bracket 13 and opening up into the larger opening 81. The smaller opening 53 is configured to receive a fastener, such as a wing nut screw or knob set screw, to secure the support rod 60 to the attachment bracket 13, as illustrated in FIGS. 1-2 and described below.

With reference now to FIGS. 5A-5D, the support arm assembly 14 comprises a support rod 60, a support block 66, and an extension arm 67. The support rod 60 is comprised of a relatively thin tube 61 having an outer wall 62 and an inner wall 63. The proximal end of the support rod 60 is configured to be inserted into the larger opening 81 in the attachment bracket 13, as shown in FIGS. 1-2. The proximal end of the support rod 60 has an opening 64, such as a through hole. The through hole 64 in the support rod 60 is configured to align with the smaller opening 53 in the attachment bracket 13. A fastener, such as a wing nut set screw or a knob set screw, is configured to extend through the openings 64 and 53 in the attachment bracket 13 and the support rod 60, respectively, and thereby secure the support rod 60 to the attachment bracket 13. In an alternative embodiment, the support rod 60 may be attached to the attachment bracket 13 by other suitable means, such as welding, bonding, or with an interference fit. Moreover, while the attachment bracket 13 and the support rod 60 have been described with reference to two separate parts, in an alternative embodiment the attachment bracket 13 and the support rod 60 may be formed as a single integrated member.

With continued reference to FIGS. 5A-5D, in one embodiment the outer wall 62 of the support rod 60 has an etched scale 65, such as a metric scale, near the distal end of the support rod 60 which permits the user to precisely position (arrow 150) a support block 66 along the length of the support rod 60. The etched scale 65 may be formed by any suitable process, such as milling or laser etching. The support block 66 is positioned along the length of the support rod 60 to achieve the desired fold width of the material fed through the folding assembly 10. In one embodiment, the etched scale 65 may indicate to the operator the fold width of the finished material and/or the centerline of the folded material. In general, the farther the support block 66 is positioned away from the attachment bracket 13 (i.e., the closer the support block 66 is to the distal end of the support rod 60), the narrower the resulting fold in the material. In contrast, positioning the support block 66 closer to the attachment bracket 13 (i.e., closer to the proximal end of the support rod 60) produces a finished material with a wider fold. In one embodiment, the distal end of the support rod 60 may be sealed off by a circular plate welded to the support rod 60. In an alternative embodiment, a button head cap is provided to seal off the distal end of the support rod 60. The button head cap may be configured for a press fit connection with the inner wall 63 of the support rod 60 and/or may be welded to the support rod 60.

Figures 5A, 5B, 5C, 5D:
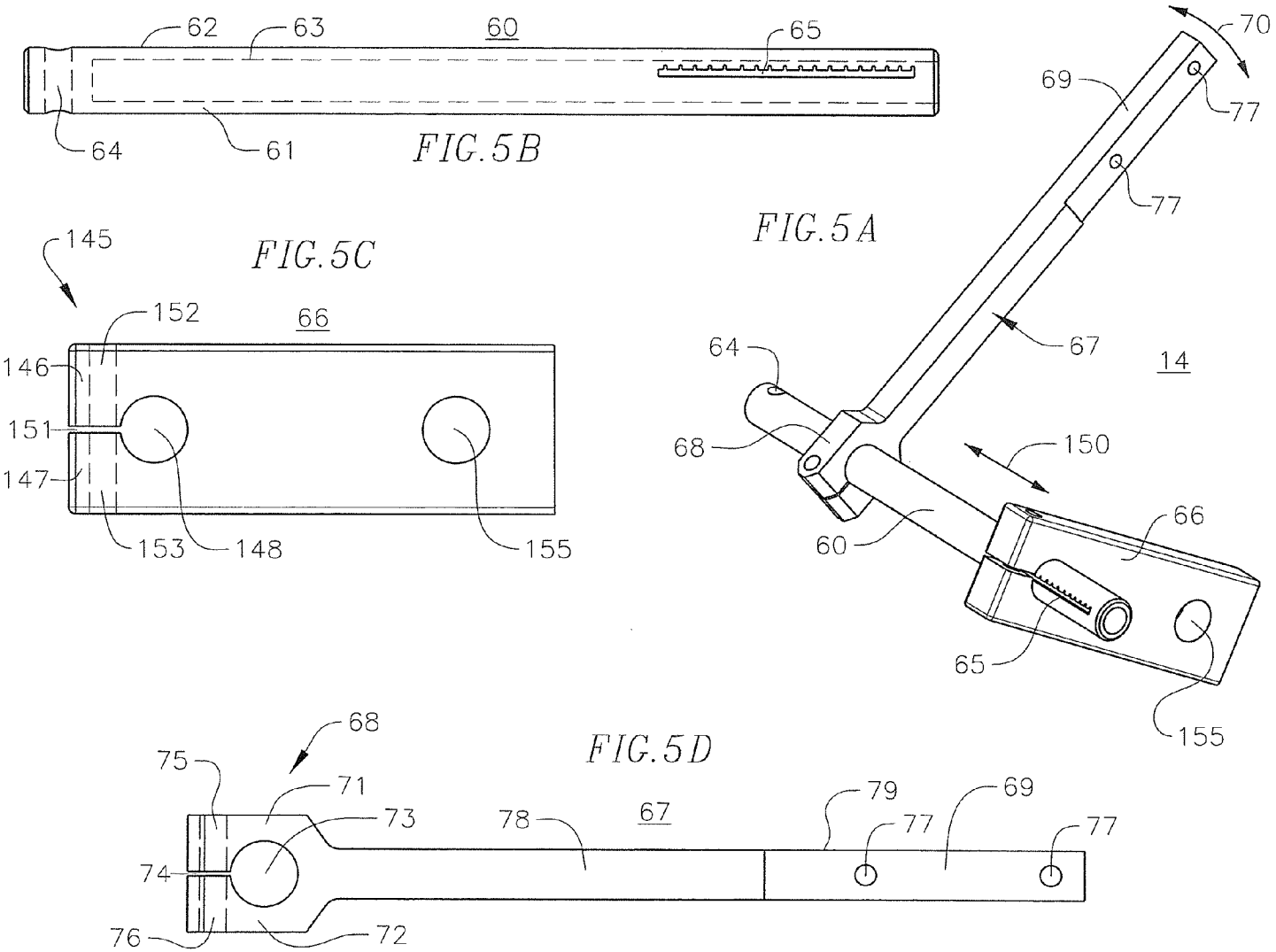
FIG. 5A is a perspective view of a support arm assembly of the folding assembly of FIG. 1.
FIGS. 5B, 5C, and 5D are side views of an embodiment of a support rod, a support block, and an extension arm, respectively, of the folding assembly of FIG. 1.

With continued reference to FIGS. 5A-5D, the support arm assembly 14 includes an extension arm 67 configured to rotatably support the roller assembly 15. A proximal end of the extension arm 67 comprises a clevis 68 and a distal end of the extension arm 67 comprises a support bar 69 extending upward from the clevis 68. The clevis 68 is configured to rotatably connect the roller assembly 15 to the support rod 60. That is, the clevis 68 is configured to enable the roller assembly 15 to rotate (arrow 70 in FIG. 5A) about the support rod 60 into different angular positions. In an alternative embodiment, the extension arm 67 may comprise a ratchet mechanism for selectively rotating the roller assembly 15 into different angular positions. As shown in FIG. 5D, the clevis portion 68 of the extension arm 67 comprises an upper prong 71 and a lower prong 72 forming a substantially circular opening 73 between the prongs 71, 72. The circular opening 73 is configured to rotatably engage the support rod 60, as shown in FIG. 5A. The clevis portion 68 of the extension arm 67 also contains a narrow slit 74 formed between the ends of the upper prong 71 and the lower prong 72. The narrow slit 74 spans between an outer edge of the clevis 68 and the circular opening 73. The slit 74 permits the clevis 68 to circumferentially expand and contract around the support rod 60, which thereby decreases or increases the force necessary to rotate (arrow 70) the extension aim 67 about the support rod 60. In one embodiment, both the upper prong 71 and the lower prong 72 of the clevis portion 68 contain internally threaded bore holes 75, 76 which are configured to receive a threaded shaft of a fastener, such as a knob set screw. The bore 75 in the upper prong 71 is coaxial with the bore 76 in the lower prong 72. When the threaded shaft of the knob set screw is fully inserted into the clevis 68, the threaded shaft orthogonally spans the slit 74 and engages the internally threaded bore holes 75, 76. Adjusting the knob set screw in the clockwise direction (i.e., tightening the fastener) decreases the width of the slit 74 and thereby causes the clevis 68 to circumferentially contract around the support rod 60. In contrast, adjusting the knob set screw in the counterclockwise direction increases the width of the slit 74 and thereby causes the clevis 68 to circumferentially expand around the support rod 60. Accordingly, as illustrated in FIG. 5A, the user adjusts the knob set screw in the counterclockwise direction, rotates (arrow 70) the extension arm 67 and roller assembly 15 into the desired angular position, and then adjusts the knob set screw in the clockwise direction to lock the roller assembly 15 into the desired angular position. In one embodiment, the desired angular position of the extension arm 67 and the roller assembly 15 is set such that a material passing over the roller assembly 15 is aligned with a back surface of the feeder plate assembly 16.

Still referring to FIGS. 5A-5D, the distal end of the extension arm 67 has a plurality of openings 77 (e.g., two) configured to attach the roller assembly 15 to the support bar 69 of the extension arm 67, as described below. Additionally, an inside surface 78 of the distal end of the extension arm 67 has a flat recessed portion 79 (also known as a "spot face") configured to receive a portion of the roller assembly 15. The flat recessed portion 79 is configured to tightly control the manufacturing tolerances of the mating surface between the roller assembly 15 and the distal end of the extension arm 67. The extension arm 67 may be formed from any suitably strong material, such as aluminum alloy, steel, or carbon fiber reinforced polymer. The extension arm 67 may be produced by any suitable means, such as casting, forging, milling, stamping, composite layering, or rapid prototyping using additive manufacturing.

With continued reference to FIGS. 5A-5D, the support arm assembly 14 also includes a support block 66, which is slideably connected to the support rod 60. In one embodiment, the support block 66 is formed from a substantially rectangular block having a distal end and a proximal end. Similar to the extension arm 67 described above, the proximal end of the support block 66 has a clevis 145 configured to slideably connect the support block 66 to the support rod 60. The clevis portion 145 of the support block 66 comprises an upper prong 146 and a lower prong 147 forming a substantially circular opening 148 between the prongs 146, 147. The opening 148 formed between the two prongs 146, 147 is configured to receive the support rod 60. The clevis 145 permits the support block 66 to slide (arrow 150 in FIG. 5A) along the support rod 60. The clevis portion 145 of the support block 66 also contains a narrow slit 151 formed between the ends of the upper and lower prong 146, 147. The narrow slit 151 spans from an outer edge of the support block 66 to the circular opening 148. The slit 151 permits the clevis 145 to circumferentially expand and contract around the support rod 60, which decreases and increases, respectively, the force necessary to slide (arrow 150) the support block 66 along the length of the support rod 60. Both the upper prong 146 and the lower prong 147 of the clevis portion 145 contain internally threaded bore holes 152, 153 which are configured to receive a fastener, such as a knob set screw. The bore 152 in the upper prong 146 is coaxial with the bore 153 in the lower prong 147. In an alternative embodiment, the upper prong 146 may comprise a smooth through bore and the lower prong 147 may comprise an internally threaded blind bore.

With continued reference to FIGS. 5A-5D, when the threaded shaft of the knob set screw is fully inserted into the clevis 145, the threaded shaft orthogonally spans the slit 151 and engages the internally threaded bore holes 152, 153. Adjusting the knob set screw in the clockwise direction decreases the width of the slit 151 and thereby causes the clevis 145 to circumferentially contract around the support rod 60 (i.e., tightening the set screw causes the upper prong 146 and the lower prong 147 to contract towards each other). In contrast, adjusting the knob set screw in the counterclockwise direction increases the width of the slit 151 and thereby causes the clevis 145 to circumferentially expand around the support rod 60. Accordingly, as illustrated in FIG. 5A, the user adjusts the knob set screw in the counterclockwise direction, slides (arrow 150) the support block 66 into the desired translational position, and then adjusts the knob set screw in the clockwise direction to lock the support block 66 into the desired translational position. In a further embodiment, the fastener extending through the clevis 145 may comprise a handle portion configured to facilitate the tightening and loosening of the fastener. As described above, the support block 66 is adjustable along the length of the support rod 60 to achieve the desired fold width of the finished material.

In one embodiment, an opening 155 (FIG. 5C) is formed in the distal end of the support block 66 for supporting the folding bracket assembly 17, as shown in FIGS. 1-2 and described below. Moreover, the distal end of the support block 66 is connected to, and supports, the feeder plate assembly 16, as shown in FIGS. 1-2. In one embodiment, the support block 66 forms a T-joint with a reinforcement plate 126, described below, and the distal end of the support block 66 is attached to the front surface of the reinforcement plate 126 by any suitable means, such as welding or fastening with countersunk screws.

Figures 6A, 6B, 6C, 6D, 6E:
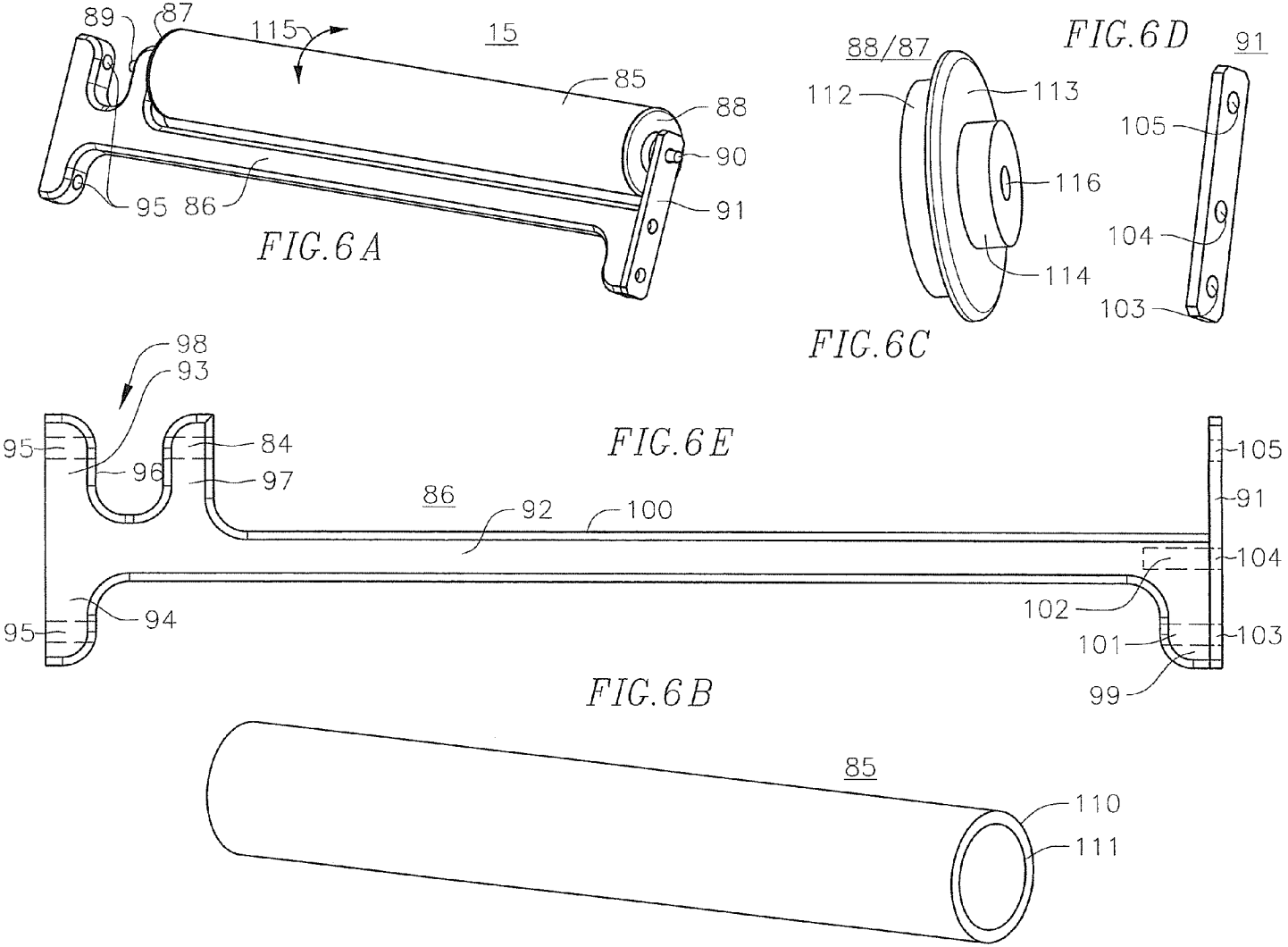
FIG. 6A is a perspective view of an embodiment of a roller assembly of the folding assembly of FIG. 1.
FIGS. 6B, 6C, and 6D are perspective views of an embodiment of a roller, a bearing, and an end plate, respectively, of the roller assembly of FIG. 1.
FIG. 6E is a front view of an embodiment of a roller support arm and an end plate of the roller assembly of FIG. 1.

Referring now to FIGS. 6A-6E, in one embodiment the roller assembly 15 comprises a roller 85, a roller support arm 86, two bearings 87, 88 on either end of the roller 85, two studs 89, 90 connected to the bearings 87, 88, respectively, and an end plate 91 supporting a distal end of the roller 85. As illustrated in FIG. 6E, the roller support arm 86 comprises a rod portion 92 extending substantially perpendicular from the extension arm 67. The rod portion 92 of the roller support arm 86 has a proximal end and a distal end opposite the proximal end. The roller support arm 86 also contains two feet 93, 94 extending from the proximal end of the rod portion 92. One foot 93 extends upward from the rod portion 92 and the other foot 94 extends downward from the rod portion 92. Together, the two feet 93, 94 and the rod portion 92 form a "T-shaped" section for attaching the roller assembly 15 to the distal end of the extension arm 67. The feet 93, 94 contain a plurality of openings 95 (e.g., two), such as through holes, that are configured to align with the openings 77 (FIGS. 5A and 5D) in the distal end of the extension arm 67. In one embodiment, the roller assembly 15 is secured to the extension arm 67 by two fasteners, such as hex head bolts, extending through the openings 95 in the feet 93, 94 and the corresponding openings 77 in the extension arm 67. In one embodiment, hex bolts having a grip length substantially equal to the combined thickness of the feet 93, 94 and the extension arm 67 are provided so that the threads of the bolts sufficiently extend past an outer surface 96 of the feet 93, 94 to permit self-locking nuts, such as kep nuts, to engage the threads of the bolts.

With continued reference to FIGS. 6A-6E, in one embodiment the roller support arm 86 also has a prong 97 extending upward from the rod portion 92 which is distal to the foot 93 extending upward from rod portion 92. The proximal prong 97 has an opening 84 configured to receive the threaded stud 89 connected to the bearing 87, as described below. The upward extending foot 93 and the upward extending proximal prong 97 form a substantially U-shaped cavity 98 configured to house the self-locking nut and the threads of the bolt securing the roller support arm 86 to the extension arm 67. Additionally, as described below, the U-shaped cavity 98 is configured to house the self-locking nut securing the proximal stud 89 to the roller support arm 86. Moreover, the cavity 98 is configured to provide sufficient clearance such that the nut securing the stud 89 and the nut securing the fastener may be installed with either hand tools or power tools.

Still referring to FIGS. 6A-6E, the distal end of the roller support arm 86 comprises a prong 99 extending downward from the rod portion 92. The distal prong 99 is configured to receive the end plate 91. Together, the distal prong 99, the end plate 91, and the proximal prong 97 form a channel 100 configured to receive the roller 85. The distal prong 99 has a plurality of openings 101, 102 (e.g., two) configured to secure the end plate 91 to the roller support arm 86. In one embodiment, the lower opening 101 is a smooth through bore and the upper opening 102 is an internally threaded blind bore. As illustrated in FIGS. 6D and 6E, the end plate 91 is formed from a relatively thin rectangular plate. The end plate 91 has a plurality of holes 103, 104 (e.g., two) configured to align with the openings 101, 102, respectively, in the distal prong 99 of the roller support arm 86. In one embodiment, the end plate 91 is secured to the roller support arm 86 by fasteners, such as hex head bolts or rivets, extending through the openings 103, 104 in the end plate 91 and the corresponding openings 101, 102 in the distal prong 99 of the roller support arm 86. The end plate 91 also has an opening 105 configured to receive the distal stud 90 on the distal end of the roller 85, as shown in FIG. 6A. While the end plate 91 and the roller support arm 86 have been described with reference to two separate parts, in an alternative embodiment the end plate 91 and the roller support arm 86 may be formed as a single integrated member.

With continued reference to FIGS. 6A-6E, in one embodiment the roller 85 is formed from a substantially cylindrical tube having a distal end and a proximal end opposite the distal end. Moreover, the roller 85 has an outer surface 110 and an inner surface 111. The distal end and the proximal end of the roller 85 are configured to receive the bearings 87, 88 with a press fit connection. In one embodiment, shown in FIG. 6C, the bearings 87, 88 contain a cylindrical protrusion 112 that is configured for a press fit connection with the inner surface 111 of the roller 85. The bearings 87, 88 also comprise a button head cap portion 113 and a smaller cylindrical protrusion 114 extending outward from the button head cap portion 113. The smaller cylindrical protrusion 114 of the bearings 87, 88 contains an opening 116 configured to rotatably receive the threaded studs 89, 90. The bearings 87, 88 are configured to permit the roller 85 to rotate (arrow 115 in FIG. 6A) about its longitudinal axis when, for example, a material is passed over the outer surface 110 of the roller 85. The threaded studs 89, 90 are configured to extend outward from the bearings 87, 88 and through the opening 105 in the end plate 91 and the opening 84 in the proximal prong 97, respectively. The roller 85 may be formed from any suitably strong and durable material, such as aluminum alloy, polypropylene, carbon fiber reinforced polymer, or acetal plastic. The roller 85 may be formed from any suitable process, such as extrusion, molding, casting, milling, plate rolling, composite layering, or rapid prototyping using additive manufacturing.

Figures 7A, 7B, 7C:
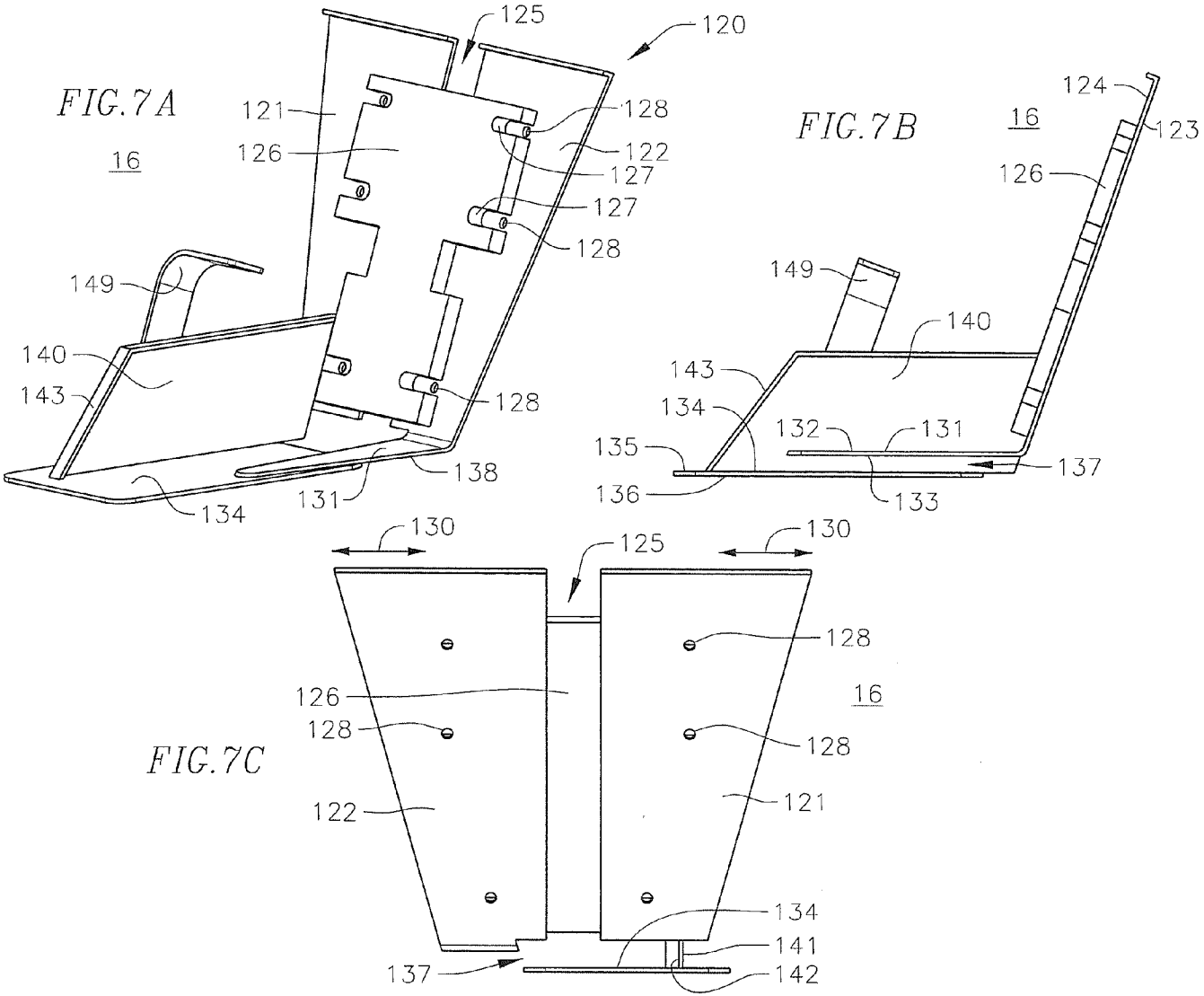
FIGS. 7A, 7B, and 7C are a perspective view, a side view, and a back view of an embodiment of a feeder plate assembly, respectively, of the roller assembly of FIG. 1.

Referring now to FIGS. 7A-7C, the feeder plate assembly 16 comprises a trapezoidal feeder plate 120 having two separate halves 121, 122. The feeder plate 120 is formed from relatively thin sheet having a back surface 123 and a front surface 124. The feeder plate 120 has a wider upper portion that tapers to a narrower lower portion. The taper in the feeder plate 120 is configured to enable a material fed down along the back surface 123 of the feeder plate 120 to fold inward. That is, as the material is fed down along the back surface 123 of the feeder plate 120, the material extends over the tapered edge of the feeder plate 120, which thereby enables the folding assembly 17 to fold the material inward. In one embodiment, a gap 125 is formed between the two halves 121, 122 of the feeder plate 120, which permits the user to expand and contract (arrow 130 in FIG. 7C) the size of the feeder plate 120 to achieve the desired fold width of the finished material. The gap 125 between the two halves 121, 122 of the feeder plate 120 is bridged by a reinforcement plate 126 connected to the front surface 124 of the feeder plate 120. The reinforcement plate 126 is formed from a relatively thick plate having a wider upper portion and a narrower lower portion. In one embodiment, the reinforcement plate 126 has a plurality of elongated slots 127 (e.g., six) configured to receive a plurality (e.g., six) of fasteners securing the reinforcement plate 126 to the feeder plate 120. The feeder plate 120 also has a plurality of openings 128 (e.g., six) configured to align with the elongated slots 127 formed in the reinforcement plate 126. The fasteners extend through openings 128 in the feeder plate 120 and through the elongated slots 127 formed in the reinforcement plate 126 in order to secure the reinforcement plate 126 to the feeder plate 120. The elongated slots 127 permit the fasteners to slide along the reinforcement plate 126 as the gap 125 between the two halves 121, 122 of the feeder plate 120 is expanded or contracted (arrow 130). In one embodiment, the elongated slots 127 are formed along a periphery of the reinforcement plate 126. In one embodiment, the fasteners securing the reinforcement plate 126 to the feeder plate 120 are countersunk screws configured such that the heads of the countersunk screws are recessed in, and substantially flush with, the back surface 123 of the trapezoidal feeder plate 120. Countersunk screws permit a material to travel smoothly along the back surface 123 of the feeder plate 120 without catching on the fasteners securing the reinforcement plate 126 to the feeder plate 120. In one embodiment, the fasteners may be secured to the reinforcement plate 126 by cap nuts resting flush on the back surface of the reinforcement plate 126. The length of the elongated slots 127 formed on the reinforcement plate 126 delineates the maximum and minimum gap 125 that can be formed between the two halves 121, 122 of the feeder plate 120. In general, the wider the gap 125 between the two halves 121, 122 of the feeder plate 120, the larger the material that may pass over the back surface 123 of the feeder plate 120. Additionally, in general, the wider the gap 125 between the two halves 121, 122 of the feeder plate 120, the narrower the resultant fold in the material.

With continued reference to FIGS. 7A-7C, in one embodiment the lower portion of the feeder plate 120 has a forwardly extending return flange 131. The return flange 131 is formed from a relatively thin sheet having an upper surface 132 and a lower surface 133. Moreover, the return flange 131 has a wider back portion that tapers to a narrower forward portion. The return flange 131 is configured to guide a material, such as a sheet of disposable wipes material, from the back surface 123 of the feeder plate 120 forward along the lower surface 133 of the return flange 131. Additionally, in one embodiment the feeder plate assembly 16 has a substantially rectangular base plate 134. The base plate 134 is formed from a relatively thin sheet having an upper surface 135 and a lower surface 136. Together, the return flange 131 and the base plate 134 form a relatively small gap 137 through which a material is configured to pass, as shown in FIGS. 7B and 7C. In other words, the material to be folded passes between the lower surface 133 of the return flange 131 and the upper surface 135 of the base plate 134. In use, a material to be folded is fed along the back surface 123 of the feeder plate 120 and then forward along the lower surface 133 of the return flange 131, and then a portion of the material to be folded is folded inward about an outer edge 138 of the return flange 131 (i.e., a portion of the material is folded inward over the return flange 131 such that the folded portion of the material rests on the upper surface 132 of the return flange 131).

With continued reference to FIGS. 7A-7C, in one embodiment the feeder plate assembly 16 has a gusset 140 and a bracket 149 connecting the base plate 134 to the support block 66. The gusset 140 is attached to the upper surface 135 of the base plate 134 by any suitable means, such as welding or fastening. The gusset 140 is comprised of a relatively thin plate having a inner surface 141 and an outer surface 142. In one embodiment, the gusset 140 has an outwardly extending flange 143 that runs along an upper end of the gusset 140 in order to provide added structural strength. In one embodiment, the bracket 149 is L-shaped and has a vertical leg and a horizontal leg. In one embodiment, the vertical leg of the L-shaped bracket 149 has an opening configured to align with an opening in the gusset 140 and to receive a fastener, such as a hex head bolt, securing the L-shaped bracket 149 to the gusset 140. Similarly, the horizontal leg of the L-shaped bracket 149 has an opening configured to align with an opening in the support block 66 and to receive a fastener securing the L-shaped bracket 149 to the support block 66.

Figure 8B:
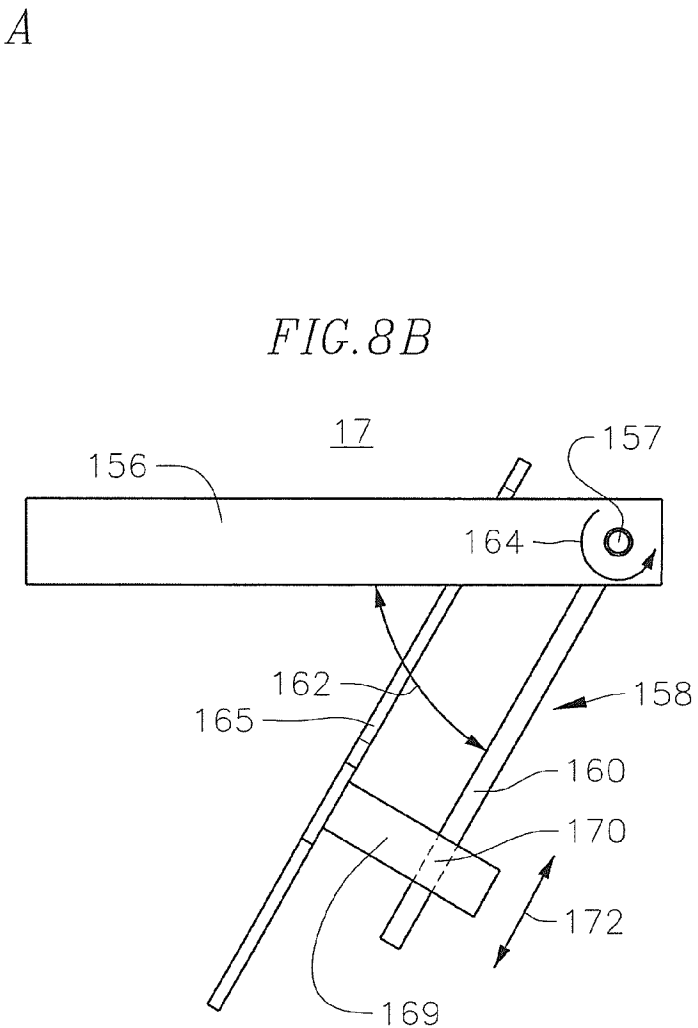
FIGS. 8A and 8B are a side perspective view and a top perspective view, respectively, of an embodiment of the folding bracket assembly of the roller assembly of FIG. 1.
Figure 8A:
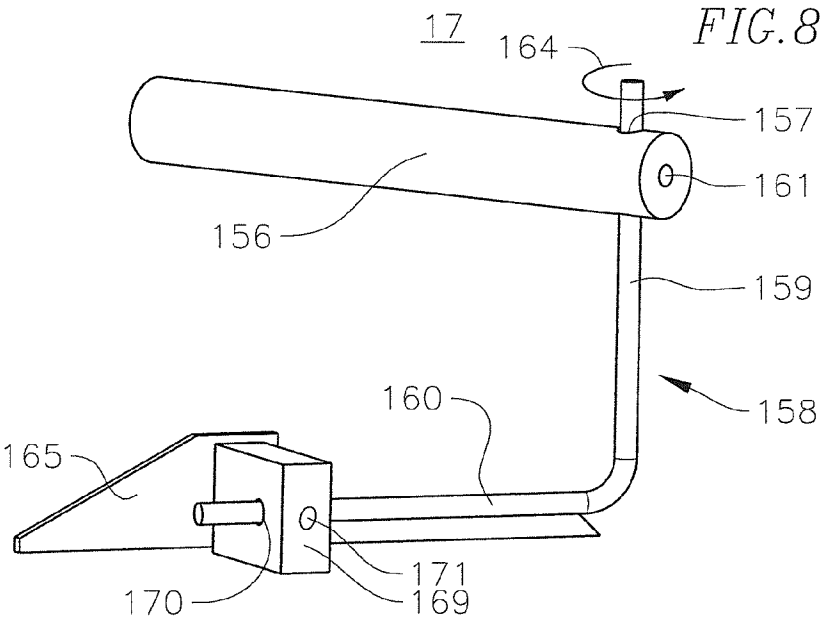

Referring now to FIGS. 8A-8B, the folding bracket assembly 17 comprises a smaller cylindrical extension rod 156 having a distal end and a proximal end. The proximal end of the smaller extension rod 156 is configured to extend through the opening 155 in the distal end of the support block 66, as shown in FIGS. 1-2. The proximal end of the smaller extension rod 156 may be secured to the support block 66 by any suitable means, such as welding or with an interference fit. The distal end of the smaller extension rod 156 has an opening 157, such as a through hole. The opening 157 is configured to rotatably receive an L-shaped rod 158 having a vertical leg 159 and a horizontal leg 160. The vertical leg 159 of the L-shaped rod 158 extends downward through the opening 157 in the distal end of the smaller extension rod 156. Additionally, the vertical leg 159 of the L-shaped rod 158 is configured to rotate (arrow 164) within the opening 157 in the smaller extension rod 156 into a desired angular position. In one embodiment, illustrated in FIG. 8A, the distal end of the smaller extension rod 156 has an opening 161, such as an internally threaded bore, configured to receive a fastener, such as a set screw. The opening 161 is substantially co-axial with the extension rod 156 and opens up into the opening 157 supporting the vertical leg 159 of the L-shaped rod 158. The fastener is configured to extend through the opening 161 and into the opening 157 to engage the vertical leg 159 of the L-shaped rod 158 extending through the opening 157. In use, the user adjusts the fastener in the counterclockwise direction, rotates (arrow 164) the L-shaped rod 158 into the desired angular position 162, and then adjusts the fastener in the clockwise direction to lock the L-shaped rod 158 into a desired angular position 162. In general, the greater the angle 162 formed between the L-shaped rod 158 and the smaller extension rod 156, the smaller the resulting fold in the material.

Figure 8C:
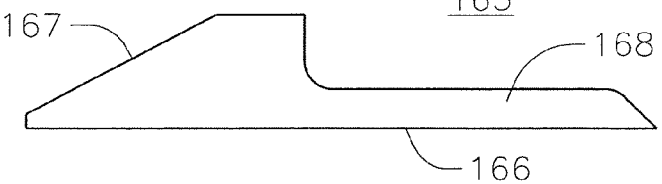
FIG. 8C is a side view of an embodiment of the folding bracket of the roller assembly of FIG. 1.

With continued reference to FIGS. 8A-8C, the folding bracket assembly 17 also comprises a folding bracket 165. The folding bracket 165 is formed from a relatively thin plate. The folding bracket 165 is comprised of a lower horizontal edge 166, a leading edge 167 extending obliquely upwards from the lower edge 166, an a tail portion 168 extending rearward from the leading edge 167. In one embodiment, the folding bracket 165 is connected to the L-shaped rod 158 by a support block 169. A distal end of the support block 169 has an opening 170, such as a through hole, configured to slideably connect the support block 169 to the horizontal leg 160 of the L-shaped rod 158. In one embodiment, the support block 169 also has an opening 171, such as an internally threaded bore, configured to receive a fastener, such as a hex head bolt or a set screw. The opening 171 spans between the distal end of the support block 169 and the opening 170. In one embodiment, the opening 171 is substantially orthogonal to the opening 170 slideably connected to the horizontal leg 160 of the L-shaped rod 158. The fastener is configured to extend through the opening 171 and into the opening 170 to engage the horizontal leg 160 of the L-shaped rod 158 extending through the opening 170, thereby preventing the horizontal leg 160 of the L-shaped rod 158 from inadvertently disengaging the opening 170 in the distal end of the support block 169. In one embodiment, a T-joint is formed between the proximal end of the support block 169 and the folding bracket 165. The proximal end of the support block 169 is connected to the folding bracket 165 by any suitable means, such as welding or fastening. In use, the user adjusts the fastener in the counterclockwise direction, slides (arrow 172 in FIG. 8B) the folding bracket 165 and the support block 169 into the desired position along the horizontal leg 160 of the L-shaped rod 158, and then adjusts the fastener in the clockwise direction to lock the folding bracket 165 and support block 169 into the desired position. In general, the closer the support block 169 and the folding bracket 165 are positioned toward the end of the horizontal leg 160 of the L-shaped rod 158, the wider the resulting fold in the material.

Figure 9:
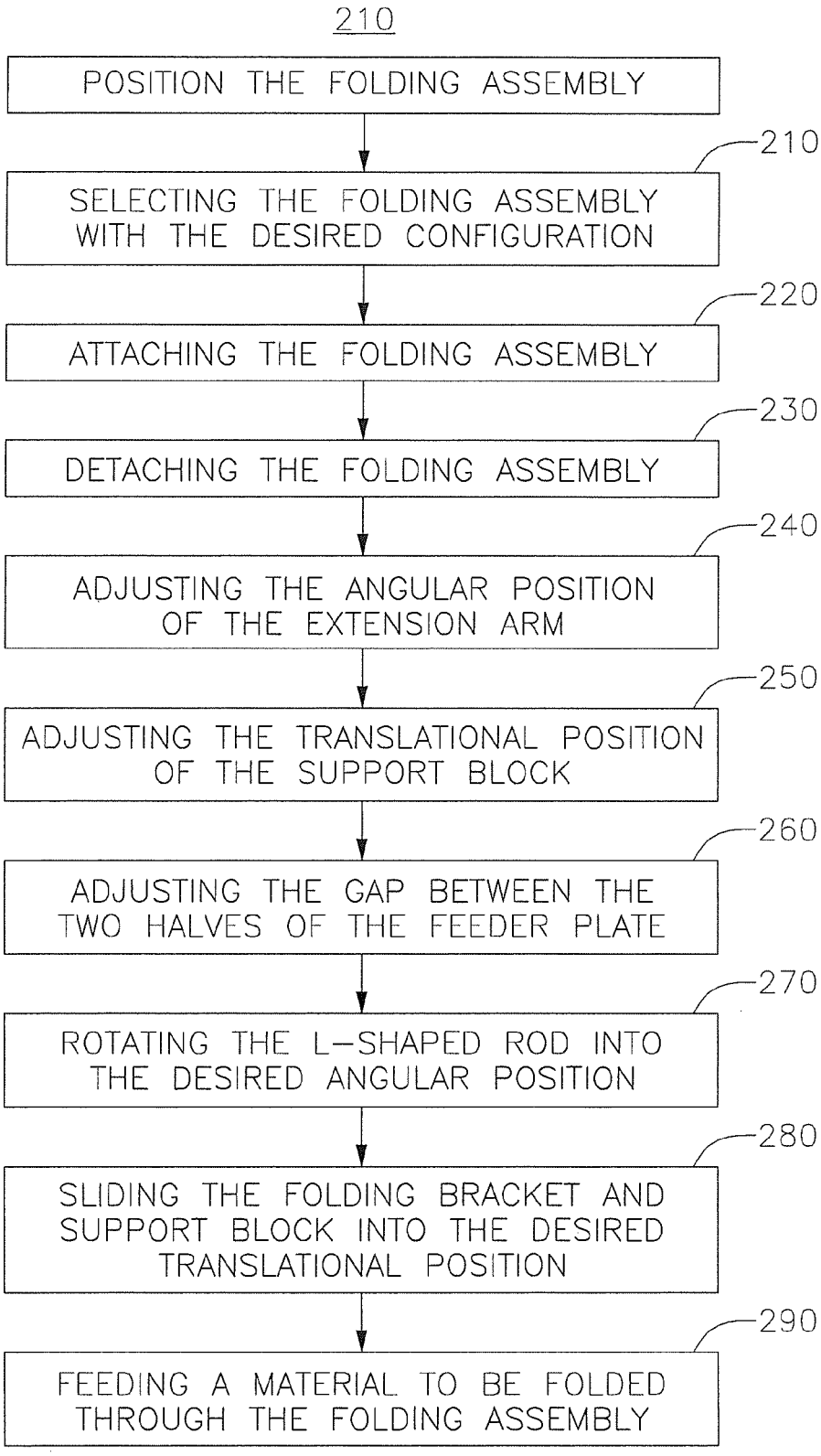
FIG. 9 is a flowchart showing tasks of a method of using a detachable folding assembly according to an embodiment of the present invention.

With reference now to FIG. 9, a method 200 of using a folding assembly 10 is shown. In one embodiment, the method 200 comprises the task 210 of selecting the folding assembly 10 with the desired configuration and the task 220 of installing the folding assembly 10 onto the support structure 11 by, for example, lowering the folding assembly 10 until the protrusions 40, 41 formed on the attachment bracket 13 engage the hooks 23, 24 formed on the mounting bracket 12. In one embodiment, the method 200 comprises the task 230 of first removing the folding assembly 10 installed on the support structure 11 by lifting the folding assembly 10 upwards until the attachment bracket 13 disengages the hooks 23, 24 formed on the mounting bracket 12. In another embodiment, the method 200 comprises the task 240 of adjusting the angular position of the extension arm 67 by loosing the set screw, thereby causing the clevis 68 to expand about the support rod 60 and then rotating (arrow 70) the extension arm 67 into the desired angular position. The user then tightens the set screw to lock the extension arm 67 into the desired angular position. In a further embodiment, the method 200 comprises the task 250 of adjusting the translational position of the support block 66 along the support rod 60 by loosening the set screw, and then sliding (arrow 150) the support block 66 into the desired position, using the etched scale 65 on the outer wall 62 of the support rod 60 as a positional reference. The user then tightens the set screw to lock the support block 66 into the desired translational position along the support rod 60.

With continued reference to FIG. 9, in yet another embodiment, the method 200 comprises the task 260 of adjusting the gap 125 between the two halves 121, 122 of the feeder plate 120 by loosening the fasteners securing the reinforcement plate 126 to the feeder plate 120 and then sliding (arrow 130) the two halves 121, 122 of the feeder plate 120 together or apart to achieve the desired gap 125. The user then tightens the fasteners securing the reinforcement plate 126 to the two halves 121, 122 of the feeder plate 120 to lock in the desired gap 125. In another embodiment, the method 200 comprises the task 270 of rotating (arrow 164) the L-shaped rod 158 supporting the folding bracket 165 into the desired angular position and then tightening a set screw to lock the L-shaped rod 158 into the desired angular position. In a further embodiment, the method 200 comprises the task 280 of sliding (arrow 172) the folding bracket 165 and the support block 169 along the horizontal leg 160 of the L-shaped rod 158 into the desired position, and then tightening the fastener to lock the folding bracket 165 and the support block 169 into the desired position. In one embodiment, the method 200 comprises the task 290 of feeding a material (e.g., a sheet of disinfectant cloth) along the outer surface 110 of the roller 85 and down along the back surface 123 of the feeder plate 120, and then forward along the lower surface 133 of the return flange 131 of the feeder plate 120. A portion of the material is then folded around the return flange 131 as the folding bracket 165 deflects the material inward over the upper surface 132 of the return flange 131. The folded material is then fed forward along the upper surface 135 of the base plate 134.

While in one embodiment, the method 200 of using the folding assembly 10 may include each of the tasks described above and shown in FIG. 9, in other embodiments of the present invention, in a method 200 of using a folding assembly 10, one or more of the tasks described above and shown in FIG. 9 may be absent and/or additional tasks may be performed. For example, the task 240 of rotating the extension arm 67 into the desired angular position may be performed without also performing the task 250 of adjusting the translational position of the support block 66. Further, in the method 200 of using the folding assembly according to one embodiment, the tasks may be performed in the order depicted in FIG. 9. However, the present invention is not limited thereto and, in a method 200 of using a folding assembly 10 according to other embodiments of the present invention, the tasks described above and shown in FIG. 9 may be performed in any other suitable sequence. For example, in one embodiment, the task 260 of adjusting the gap 125 between the two halves 121, 122 of the feeder plate 120 is performed before the task 270 of rotating the L-shaped rod 158, while in an alternative embodiment, the task 270 of rotating the L-shaped rod 158 is performed before the task 260 of adjusting the gap 125 between the two halves 121, 122 of the feeder plate 120.

The preceding description has been presented with reference to various embodiments of the invention. Persons skilled in the art and technology to which this invention pertains will appreciate that alterations and changes in the described structures and methods of operation can be practiced without meaningfully departing from the principles, spirit, and scope of this invention as recited in the following claims. For example, the present folding assembly may be used when folding materials other than disposable wipes. Disposable wipes have been used herein as the choice material for illustrative purposes only.

What is claimed is:

1. An assembly for folding materials, the assembly comprising:

an attachment bracket configured to detachably connect the assembly to a structural member;

a roller configured to be coupled to the attachment bracket;

a feeder plate configured to be coupled to the attachment bracket, the feeder plate having a return flange;

a folding bracket configured to be coupled to the attachment bracket, the folding bracket configured to fold at least a portion of a material about the return flange;

a support rod having a distal end and a proximal end opposite the distal end, the proximal end configured to connect to the attachment bracket; and an extension arm having a clevis portion and a support bar opposite the clevis portion, the clevis portion configured to rotatably connect to the support rod, and the support bar configured to rotatably support the roller.

2. The assembly of claim 1, further comprising:

a mounting bracket having at least one hook portion forming a U-shaped cavity, wherein the cavity is configured to detachably receive the attachment bracket.

3. The assembly of claim 1, further comprising:

a support rod configured to connect to the attachment bracket;

a support block having a distal end and a proximal end opposite the distal end, the proximal end having a clevis portion configured to slidably connect to the support rod, the distal end configured to support the feeder plate.

4. The assembly of claim 3, further comprising an etched scale formed on the distal end of the support rod.

5. The assembly of claim 3, further comprising:

an opening formed in the distal end of the support block; and a second support rod having a distal end and a proximal end opposite the distal end, the proximal end of the second support rod configured to extend through the opening in the distal end of the support block, and the distal end of the second support rod having an opening.

6. The assembly of claim 5, further comprising:

an L-shaped rod having a vertical leg and a horizontal leg, the vertical leg configured to rotatably connect to the opening of the distal end of the second support rod, and the horizontal leg configured to connect to the folding bracket.

7. The assembly of claim 3, further comprising:

a fastener configured to extend through the clevis portion of the support block, wherein loosening the fastener causes the clevis to circumferentially expand, and wherein tightening the fastener causes the clevis to circumferentially contract.

8. The assembly of claim 1, further comprising:

a reinforcement plate configured to connect to the feeder plate, the reinforcement plate having at least one elongated slot oriented in a first direction, wherein the feeder plate is comprised of two tapered halves forming a gap therebetween, and wherein the gap is adjustable between a closed position and an open position along the first direction.

9. An assembly for folding materials, comprising:

a mounting bracket attached to a support member, the mounting bracket having at least one hook portion;

an attachment bracket configured to detachably connect to the at least one hook portion;

a support assembly comprising a support rod and an extension arm, the support rod connected to the attachment bracket, and the extension rod having a proximal end configured to rotatably connect to the support rod and a distal end opposite the proximal end configured to support a roller assembly, wherein the roller assembly comprises a roller and a roller support arm configured to rotatably support the roller;

a feeder plate assembly having a return flange;

a support block having a proximal end slidably connected to the support rod and a distal end opposite the proximal end connected to the feeder plate assembly; and a folding bracket coupled to the support block, wherein the folding bracket is configured to fold a material around the return flange.

10. A method of forming a folded material using a folding assembly comprising a mounting bracket, an attachment bracket configured to be detachably connected to the mounting bracket, a support rod connected to the attachment bracket, a roller assembly rotatably coupled to the support rod, a support block slidably connected to the support rod, a feeder plate assembly connected to the support block, wherein the feeder plate assembly includes a feeder plate having a return flange and two tapered halves forming a gap therebetween, and a folding bracket assembly coupled to the support block, wherein the folding bracket assembly comprises an L-shaped rod and a folding bracket slidable along the L-shaped rod, the method comprising:

positioning the folding assembly between a first position and a second position; and feeding a sheet of material to be folded, comprising:

feeding the material around the roller;

feeding the material along a back surface of the feeder plate; and feeding the material forward along a lower surface of the return flange, wherein the folding bracket folds a portion of the sheet of material around the return flange to form the folded material.

11. The method of claim 10, wherein positioning the folding assembly comprises adjusting the angular position of the roller assembly.

12. The method of claim 10, wherein positioning the folding assembly comprises adjusting the translational position of the support block along the support rod according to a desired fold width.

13. The method of claim 10, wherein positioning the folding assembly comprises adjusting the gap between the two tapered halves of the feeder plate.

14. The method of claim 10, wherein positioning the folding assembly comprises adjusting the angular position of the folding bracket assembly.

15. The method of claim 10, wherein positioning the folding assembly comprises adjusting the translational position of the folding bracket along a horizontal leg of the L-shaped rod.

16. The method of claim 10, further comprising:

detaching the folding assembly by lifting the attachment bracket out of the mounting bracket;

selecting a folding assembly with a desired configured according to a desired fold width; and attaching the folding assembly with the desired configuration by lowering the attachment bracket into the mounting bracket.

17. The method of claim 10, wherein the sheet of material to be folded comprises a sheet of disposable wipes for disinfectant use or personal hygienic use.

* * * * *

UNITED STATES PATENT AND TRADEMARK OFFICE

CERTIFICATE OF CORRECTION

PATENT NO. : 8,801,585 B2
APPLICATION NO. : 13/586720
DATED : August 12, 2014
INVENTOR(S) : Steven W. Carter It is certified that error appears in the above-identified patent and that said Letters Patent is hereby corrected as shown below:

On the Title Page

Item (57) Abstract, line 11 Delete "is a fed over",

Insert --is fed over--

Signed and Sealed this
Fourteenth Day of June, 2016

Michelle K. Lee

Michelle K. Lee
*Director of the United States Patent and Trademark Office*